United States Patent [19]

Tawada

[11] Patent Number: 4,804,608

[45] Date of Patent: Feb. 14, 1989

[54] AMORPHOUS SILICON PHOTORECEPTOR FOR ELECTROPHOTOGRAPHY

[75] Inventor: Yoshihisa Tawada, Kobe, Japan

[73] Assignee: Kanegafuchi Chemical Industry Co., Ltd., Osaka, Japan

[21] Appl. No.: 129,346

[22] Filed: Nov. 22, 1987

Related U.S. Application Data

[63] Continuation of Ser. No. 873,848, Jun. 11, 1986, abandoned, which is a continuation of Ser. No. 639,402, Aug. 10, 1984, abandoned.

[30] Foreign Application Priority Data

Aug. 16, 1983 [JP] Japan ..... 58-150882

[51] Int. Cl.[4] ..... G03G 5/082

[52] U.S. Cl. ..... 430/85; 430/56; 430/84; 430/95

[58] Field of Search ..... 430/56, 57, 84, 85, 430/95; 427/74; 357/2; 252/501.1

[56] References Cited

U.S. PATENT DOCUMENTS

| | | | |
|---|---|---|---|
| 4,210,710 | 7/1980 | Boxby | 430/56 |
| 4,414,319 | 11/1983 | Shirai et al. | 430/84 X |
| 4,460,669 | 7/1984 | Ogawa et al. | 430/57 |
| 4,490,453 | 12/1984 | Shirai et al. | 427/74 X |

*Primary Examiner*—Roland E. Martin

*Attorney, Agent, or Firm*—Wegner & Bretschneider

[57] ABSTRACT

A photoreceptor for electrophotography which comprises an electroconductive substrate and a photoconductive layer formed thereon, said photoconductive layer essentially consisting of a thin film of amorphous silicon alloy containing at least one of hydrogen and fluorine and having the formula: a-$Si_{1-m}X_m$:Y wherein X is C, N or O, Y is at least one of H and F and m is a number of not less than zero and less than one, m being gradually decreased from the top surface of the photoconductive layer to the middle part of the photoconductive layer and gradually increased from the middle part of the photoconductive layer to the interface of the photoconductive layer with the electroconductive substrate in the direction of thickness, said photoreceptor having good electric charging property and photoconductivity characteristics.

7 Claims, No Drawings

AMORPHOUS SILICON PHOTORECEPTOR FOR ELECTROPHOTOGRAPHY

This application is a continuation of U.S. application Ser. No. 873,848, filed June 11, 1986, now abandoned, which is a continuation of U.S. application Ser. No. 639,402, filed Aug. 10, 1984, now abandoned.

The present invention relates to a photosensitive element for electrophotography. More particularly, it relates to a photosensitive element for electrophotography using amorphous silicon alloys.

A photoreceptor for electrophotography comprises an electroconductive substrate and a photoconductive layer provided thereon. For the photoconductive layer, there have been widely used inorganic photoconductive materials such as amorphous selenium, cadmium sulfide, cadmium selenide and zinc oxide. While a photoconductive layer is required to have high electric charging property and good photoconductive characteristics, said conventional inorganic photoconductive materials are still unsatisfactory in those respects.

Recently, the use of amorphous silicon containing hydrogen and/or fluorine such as a-Si:H, a-Si:F or a-Si:H:F (the prefix "a-" indicating "amorphous") for the photoconductive layer was proposed. Its photosensitive wavelength region is so broad as covering a range of from blue to red, and its mechanical strength in the form of a thin film is quite good. Advantageously, it is substantially non-toxic. Unfortunately, however, its thin film is low in electric charging property. Because of this reason, various studies have been made to provide amorphous silicon alloys having sufficient photosensitivity and satisfactory electric charging property.

For enhancing electric charging property, there have been proposed two methods, of which one comprises doping amorphous silicon with an impurity so as to decrease the mobility or lifetime of the carrier, whereby the electroconductivity at dark ($\sigma_d$) is lowered [Japanese Patent Publn. (unexamined) No. 156834/81; Japanese Journal of Applied Physics, 21, Suppl. 20-1, 305 (1981)]. In this method, however, the movement of the carrier produced by light is simultaneously inhibited so that the response speed is decreased in comparison with that of amorphous silicon not containing any impurity. Further, the formation of a uniform film with amorphous silicon containing an impurity (especially oxygen) meets various technical difficulties.

The other method comprises providing the photoconductive layer of amorphous silicon with a blocking layer so as to prevent the entrance of the carrier from the electrode into said photoconductive layer [Modern Amorphous Silicon Handbook, "Application to Electronic Copying Machine", published by Science Forum]. The blocking layer is provided at the interface of the photoconductive layer with the electroconductive substrate and may be made of amorphous silicon of n or p type. By this procedure, there can be obtained amorphous silicon, of which the electric charging property is so high as around 40 V/$\mu$m and the response to light is sufficiently rapid. In addition to the blocking layer at the interface with the electroconductive substrate, a stabilization layer (passivation layer) may be provided on the top surface of the photoconductive layer for stabilization of the electric charging property and the light response characteristics [Japanese Patent Publn. (unexamined) Nos. 58159/82 and 58161/82]. This procedure utilizes efficiently the potential barrier at the interface of the hetero junction. However, the characteristics of the photoreceptor are much influenced by the state of the interface of the hetero junction; namely, a slight change in the reaction conditions on the manufacture affords unfavorably great variations in electric charging property and light response of the photoreceptor. For the blocking layer, an insulating film of $SiO_x$ or $SiN_x$ may be used; for instance, the formation of a blocking layer consisting of an a-$Si_{1-n}N_n$:H film of 300 Å in thickness on the surface of the electroconductive substrate gives a photoreceptor having good electric charging property and high sensitivity [Japanese Patent Publn. (unexamined) Nos. 62053/82, 62054/82 and 62055/82].

The basic object of the present invention is to provide a photoreceptor for electrophotography which shows enhanced electric charging property and good light response characteristics without decrease of the mobility and lifetime of the carrier and without formation of a hetero junction. Namely, the incorporation of any impurity is suppressed to a minimum so that the influence onto the mobility and lifetime of the carrier is made as slight as possible, while the electric charging property is enhanced by changing gradually the composition of the photoconductive layer in the direction of thickness.

According to the present invention, there is provided a photoreceptor for electrophotography which comprises an electroconductive member and a photoconductive substrate provided thereon, said photoconductive layer essentially consisting of a thin film of amorphous silicon containing at least one of hydrogen and fluorine and having the formula: a-$Si_{1-m}X_m$:Y wherein X is C, N or O, Y is at least one of H and F and m is a number of not less than zero and less than one, m being gradually decreased from the top surface of the photoconductive layer to the middle part of the photoconductive layer and gradually increased from the middle part of the photoconductive layer to the interface of the photoconductive layer with the electroconductive substrate in the direction of thickness.

Since the structure of the photoreceptor of the invention does not have an interface due to a junction such as P-n junction, P-i-n junction or n-P junction, there is no increase of the defect at the junction; the trap or recombination of the carrier due to the defect is thus decreased, and as the result, the photoconductivity gain may be enhanced. The photoconductive layer in the photoreceptor of the invention exerts a blocking effect without any definite formation of a blocking layer such as an n-type a-Si:H layer or a p-type a-Si:H layer at the interface of the photoconductive layer with the electroconductive substrate, and the mobility of the carrier is not significantly blocked.

The structure of the photoreceptor according to the invention may appear to be similar to the MIS type structure having an insulating film as the blocking layer. However, the former is greatly different from the latter in not having any interface between the insulating layer and the photoconductive layer so that the trap or recombination of the carrier occurring at the interface can be avoided.

The characteristics of a photoreceptor having the MIS type structure are much infuenced by the characteristics of the insulating layer. When the thickness of the insulating layer is large, the carrier can not pass through the insulating layer so that the photoconductivity gain is markedly lowered. When the thickness of the insulating layer is small, the overall characteristics are associated with the evenness of the insulating layer, the presence of pinholes in the insulating layer, the mobility and lifetime of the carrier, etc. For preparation of a uniform insulating layer having no pinhole, particularly of so thin as several hundreds Å in thickness, the strict control of the conditions for manufacture is necessary. In order to prevent the trap and recombination of the carrier at the interface between the insulating layer and the photoconductive layer, it may be considered to promote the movement of the carrier by control of the Fermi level. At the interface of the hetero junction of the MIS type structure, there may be produced an interface level due to the difference of the constituting elements in the two layers, and this can not be prevented merely by control of the Fermi level.

In the photoreceptor of the invention, the electroconductive substrate may be constituted, for instance, with an aluminum foil, an aluminum plated polymeric sheet, an aluminum plated stainless steel sheet, etc.

The photoconductive layer is constituted with an amorphous silicon alloy deposited on the electroconductive substrate. Namely, the elements constituting the amorphous silicon alloy from their sources are deposited with variation of their proportion to make a photoconductive layer initially having a broad bandgap and later having a narrow bandgap. Since the thus formed photoconductive layer has no interface with the insulating layer as recognized in the MIS type structure, the movement of the carrier can be effected smoothly without control of the Fermi level. The resulting photoreceptor has electric and mechanical characteristics sufficiently suitable for electrophotography.

The amorphous silicon alloy constituting the photoconductive layer of the photoreceptor of the invention may essentially consist of silicon, carbon and hydrogen, silicon, nitrogen and hydrogen, or silicon, oxygen and hydrogen. The sources for these elements may be silane, methane, ammonia, nitrogen, oxygen, water, etc.

For the sake of convenience, the manufacture of the photoreceptor will be hereinafter explained more in detail taking the amorphous silicon essentially consisting of silicon, carbon and hydrogen. The substantially same procedure as below may be considered to be applicable to the case where fluorine or fluorine and hydrogen is/are used in place of hydrogen.

It is known that a film of the amorphous silicon alloy of a-$Si_{1-m}C_m$:H can be prepared from methane and silane by the glow discharge procedure [Tawada et al.: Japanese Journal of Applied Physics, 20, Suppl. 20-2, 219–225 (1980); Journal of Applied Physics, 53, 5273–5281 (1982); Solar Energy Materials, 6, 299–315 (1982)]. The resulting film has high resistance and good photoconductivity characteristics. The optical bandgap (Eop) of the film can be varied within a wide range of 2.8 to 1.6 ev by modifying the carbon content therein. The film having a larger Eop value has high resistance at dark and shows good insulation characteristics. The film having a smaller carbon content absorbs light within a broad range of blue to red and shows good photoconductivity. For the application to photoelectrography, the film is required to have favorable values in electric charging property and photoconductivity gain, i.e. from 25 to 50 V/μm in electric charging property and from 0.1 to 1.0 in photoconductivity gain. The film having a smaller carbon content can, as stated above, absorb visible light well and is good in photoconductivity characteristics. However, it is small in electric charging property and not suitable for electrophotography.

For preparation of the photoreceptor of the invention, the deposition of the amorphous silicon alloy on the electroconductive substrate to make a photoconductive layer may be carried out by said glow discharge procedure but with modification of the carbon content. Namely, the deposition of the elements constituting the amorphous silicon alloy is started with their proportion giving a large Eop value so that the amorphous silicon alloy having a larger carbon content is deposited on the electroconductive substrate at the initial stage. Then, the deposition is continued up to make the middle part of the photoconductive layer, during which the elemental proportion is changed gradually to decrease the carbon content so that the amorphous silicon alloy having a carbon content of not more than 10 atm %, preferably of 3 to 0.0005 atm %, is deposited. Thereafter, the deposition is further continued to make the photoconductive layer from the middle part to the surface part, during which the elemental proportion is gradually changed so as to increase the carbon content. The highest Eop value and the highest resistance are thus given at the top surface. The photoconductive layer formed as above has usually a thickness of several thousands Å to 200 μm.

The variation of the carbon content is not always required to be made in the manner as stated above, i.e. from large to small and then small to large in a linear or exponential and continuous manner in the direction of thickness. In other words, the variation of the carbon content may be controlled in such a manner as affording the desired photoconductivity characteristics (e.g. electric charging property, photoconductivity, film stability, durability) of the photoreceptor. In any event, however, the abrupt change of the carbon and hydrogen contents to the silicon content should be avoided, because such abrupt change may result in formation of the interface and also decrease the photoconductivity gain. As understood from the above, the photoreceptor of the invention is characteristic in having a structure different from the conventional blocking structure such as the p-i, n-i junction or the MIS type structure and having little variation of characteristics on its manufacture.

The amorphous silicon alloy of a-$Si_{1-m}N_m$:H may be produced in the similar manner as above but using silane-ammonia or silane-nitrogen gas. When the nitrogen content is larger, it gives better insulating characteristics. When the nitrogen content is smaller, better photoconductivity characteristics are shown. By formation of the layer of said amorphous silicon alloy with the continuously decreased nitrogen content from the interface with the electroconductive substrate to the middle part and the continuously increased nitrogen content from the middle part to the top surface, there is obtained a photoreceptor with good electric charging property and photoconductivity characteristics suitable for electrophotography. For instance, in case of using $NH_3$ as the nitrogen source, the volume proportion of $SiH_4$ and $NH_3$ may be controlled to be from 1/20 to 20 by volume at the interface with the electroconductive substrate and at the top surface and from 10 to 10,000,000 by volume at the middle part. It is not always necessary to make a linear or exponential variation of the nitrogen content from the interface with the electroconductive subcontent strate to the middle part and/or from the middle part to the top surfrace. The variation may be thus so controlled as complying with the desired photoconductivity characteristics. However, the abrupt change of the nitrogen and hydrogen contents to the silicon content should be avoided.

The amorphous silicon alloy of a-$Si_{1-m}O_mH$ may be produced in the similar manner as above but using silane-water or silane-oxygen gas. When the oxygen content is larger, it gives better insulating characteristics. When the oxygen content is smaller, better photoconductivity characteristics are shown. By formation of the layer of said amorphous silicon alloy with the continuously decreased oxygen content from the interface with the electroconductive substrate to the middle part and the continuously increased oxygen content from the middle part to the top surface, there is obtained a photoreceptor with good electric charging property and photoconductivity characteristics suitable for electrophotography. The variation of the oxygen content may be so controlled as complying with the desired photoconductivity characteristics. However, the abrupt change of the oxygen and hydrogen contents to the silicon content should be avoided.

In general, the Fermi level of the amorphous silicon alloy of a-$Si_{1-m}X_mH$ (wherein X is C, N or O) is shifted to the conduction band or the valence band region side depending upon the value of m. Such shifting is favorable in some certain cases for the use as an photoreceptorfor electrophotography, but it is not favorable in some other cases. When the shifting occurs unfavorably, the Fermi level can be modified to make favorable by doping with B or P as in conventional p or n control.

Practical embodiments of the invention are illustratively shown in the following examples.

EXAMPLE 1

As the electroconductive substrates, there were used (a) an aluminium foil and (b) an Oxford glass vapor-plated with aluminum to make semi-transparent aluminum electrodes. Amorphous silicon carbide containing hydrogen (i.e. a-$Si_{1-m}C_mH$) was deposited on each of the substrates using a gaseous mixture of $SiH_4$, $CH_4$ and $H_2$ (all being the commercial products of highest degree) by the aid of a capacitance-coupled type glow discharge CVD apparatus under the following conditions to make a thin amorphous silicon carbide film as the photoconductive layer: capacity of reaction vessel, about 10 liters; total pressure adjusted to 1 Torr using $H_2$ as carrier gas; RF (ratio frequency) glow, 13.56 MHz; electric power, about 60 W; substrate temperature, about 250° C. At the initiation of glow discharge, the flow ratio of $CH_4/SiH_4$ in the gaseous mixture was 50/50 (by volume), and the flow rates of $CH_4$ and $SiH_4$ were respectively 100 ml/min and 100 ml/min. Immediately after the initiation of glow discharge, the $CH_4/SiH_4$ flow ratio was started, to decrease gradually and continuously under the following conditions to make 10/90 (by volume) after 40 minutes: flow rate of $CH_4$ and $SiH_4$, 200 ml/min; decreasing flow rate of $CH_4$, 2.0 (ml/min)/min; increasing flow rate of $SiH_4$, (2.0 ml/min)/min. After 40 minutes from the initiation of glow discharge, the flow rate of $CH_4/SiH_4$ was fixed at 10/90 (by volume), and glow discharge was continued over a period of about 4 hours. Then, the flow rate of $CH_4/SiH_4$ was increased under the following conditions to make 50/50 by volume) in 40 minutes: flow rate of $CH_4$ and $SiH_4$, 200 ml/min; increasing flow rate of $CH_4$, (2.0 ml/min)/min. The thickness of the photoconductive layer as ultimately formed was about 4.4 μm.

The photoconductivity of the photoconductive layer (a-$Si_{1-m}C_m$:H) was measured by the use of the static mode of an electrostatic paper analyzer (manufactured by Kawaguchi Electric Co., Ltd.). As the light source, light monochromated by a monochrometer was used. From the light attenuation curve (PID curve) on negatively charged with 6 KV and the photoconductivity gain graph, it was confirmed that the initial photoconductivity gain was so good as from 0.5 to 0.7 for the light of a wide range of 450 to 650 nm, and the electric charging property was from 40 to 50 V/μm.

It is thus clear that the photoreceptor prepared by this Example is sufficiently suitable for electrophotography in electric charging property and photoconductivity characteristics.

REFERENCE EXAMPLE 1

As the electroconductive substrates, there were used (a) an aluminium foil, (b) an Oxford glass and (c) an Oxford glass vapor-plated with aluminum to make semi-transparent aluminum electrodes. Amorphous silicon carbide (i.e. a-$Si_{1-m}C_m$:H) was deposited on each of the electroconductive substrates using a gaseous mixture of $SiH_4$, $CH_4$ and $H_2$ (all being the commercial products of highest degree) by the aid of a capacitance-coupled type glow discharge CVD apparatus under the conditions of fixed gas flow ratio ($SiH_4/CH_4$=50/50) to make a thin amorphous silicon carbide film of about 4.0 μm in thickness as the photoconductivie layer.

According to the V-I measurement, the dark conductivity, the photoconductivity and the activation energy of the carrier were determined. The results were as follows: dark conductivity, $\sigma_d=10^{-16}\Omega^{-1}cm^{-1}$; photoconductivity, $\sigma_p=3\times10^{-10}\Omega^{-1}cm^{-1}$; activation energy of carrier, $\Delta E=1.07$ev. Since the difference between the dark conductivity and the photoconductivity is of six figures, it may be said to have a good photoconductivity. However, the examination of the thin semi-conductor film with a electrostatic paper analyzer (manufactured by Kawaguchi Electric Co., Ltd.) revealed that the electric charging property is 45 V/μm under the application of -6 KV and the initial photoconductivity gain was 0.01. It is thus clear that the photoreceptor prepared by the conventional procedure is not suitable for electrophotography in showing an extremely low initial photoconductivity gain.

What is claimed is:

1. A photoreceptor for electrophotography which consists essentially of an electroconductive substrate and a photoconductive layer provided thereon, said photoconductive layer consisting essesntially of a thin film of amorphous silicon alloy containing at least one of hydrogen and fluorine and having the formula: a-$Si_{1-m}X_m$:y wherein X is C, N or O, Y is at least one of H and F and m is a number greater than or equal to zero and less than one, m being gradually decreased from the top surface of the photoconductive layer to the middle part of the photoconductive layer and gradually increased from the middle part of the photoconductive layer to the interface of the photoconductive layer with the electroconductive substrate in the direction of thickness.

2. The photoreceptor according to claim 1, wherein the amorphous silicon alloy comprises Si, C and H, and the C content therein gradually and continuously decreases from the top surface of the photoconductive layer to the middle part of the photoconductive layer and gradually and continuously increases from the middle part of the photoconductive layer to the interface of the photoconductive layer with the electroconductive substrate in the direction of thickness.

3. The photoreceptor according to claim 1, wherein the amorphous silicon alloy comprises Si, N and H, and the N content therein gradually and continuously decreases from the top surface of the photoconductive layer to the middle part of the photoconductive layer and gradually and continuously increases from the middle part of the photoconductive layer to the interface of the photoconductive layer with the electroconductive substrate in the direction of thickness.

4. The photoreceptor according to claim 1, wherein the amorphous silicon alloy comprises Si, O and H, and the O content therein gradually and continuously decreases from the top surface of the photoconductive layer to the middle part of the photoconductive layer and gradually and continuously increases from the middle part of the photoconductive layer to the interface of the photoconductive layer with the electroconductive substrate in the direction of thickness.

5. The photoreceptor according to claim 1, wherein the electroconductive substrate consists essentially of an electroconductive metal layer.

6. The photoreceptor according to claim 5, wherein the metal layer is made of an electrocondutive metal film.

7. The photoreceptor according to claim 6, wherein the metal film is the one formed on a polymeric film by vapor plating.

* * * * *